United States Patent [19]

Smith

[11] Patent Number: 4,993,580

[45] Date of Patent: Feb. 19, 1991

[54] INSULATED BEVERAGE CONTAINER

[76] Inventor: Glen R. Smith, 800 E. Aloha St., Seattle, Wash. 98102

[21] Appl. No.: 509,714

[22] Filed: Apr. 16, 1990

[51] Int. Cl.[5] ..... B65D 5/56; B65D 25/18

[52] U.S. Cl. ..... 220/443; 220/441; 229/90; 206/594

[58] Field of Search ..... 220/903, 401, 443, 441, 220/85 H; 229/90, DIG. 2; 428/34.2, 184; 206/591, 594

[56] References Cited

U.S. PATENT DOCUMENTS

| | | | |
|---|---|---|---|
| 2,589,645 | 3/1952 | Tiegel | 229/90 |
| 3,013,691 | 12/1961 | Prentice | 220/903 |
| 3,443,715 | 5/1969 | Edwards | 220/441 |
| 3,935,357 | 1/1975 | Padovani | 206/594 |
| 3,941,237 | 3/1976 | MacGregor | 220/85 H |
| 3,951,730 | 4/1976 | Wennberg et al. | 206/594 |
| 4,398,650 | 8/1983 | Holmes et al. | 220/443 |
| 4,399,668 | 8/1983 | Williamson | 220/903 |
| 4,534,391 | 8/1985 | Ventimiglia et al. | 220/903 |
| 4,700,862 | 10/1987 | Carter et al. | 220/443 |
| 4,821,915 | 4/1989 | Mayer | 220/441 |

FOREIGN PATENT DOCUMENTS

| | | | |
|---|---|---|---|
| 1373348 | 12/1964 | France | 220/441 |
| 334302 | 6/1936 | Italy | 428/184 |

OTHER PUBLICATIONS

IBM Technical Disclosure Bulletin, Moran et al., "Thermal Shipping Container", vol. 22, No. 3, 8/1979, pp. 1111-1113.

*Primary Examiner*—Stephen Marcus
*Assistant Examiner*—S. Castellano
*Attorney, Agent, or Firm*—Leon Gilden

[57] ABSTRACT

A container organization including an exterior wall spaced from an interior wall defining a conical body formed with a reinforced rib at its upper end and a floor at its lower end. The body includes an insulated medium therebetween. The insulated medium includes circumferentially equally spaced ribs therealong either alone or in association with a sinusoidal corrugating medium wherein the corrugating medium may be mounted directly to the ribs or spaced therefrom by an intermediate wall. A plurality of insulated mediums may be utilized offset relative to one another by one-half amplitude relative to one another to effect adhesive contact between upper and lower peaks of respective lower and upper sinusoidal corrugating mediums. Further, a single sinusoidal medium may be utilized spaced from the interior and exterior walls by offset ribs adhesively mounted to alternating upper and lower peaks of the corrugating medium.

1 Claim, 5 Drawing Sheets

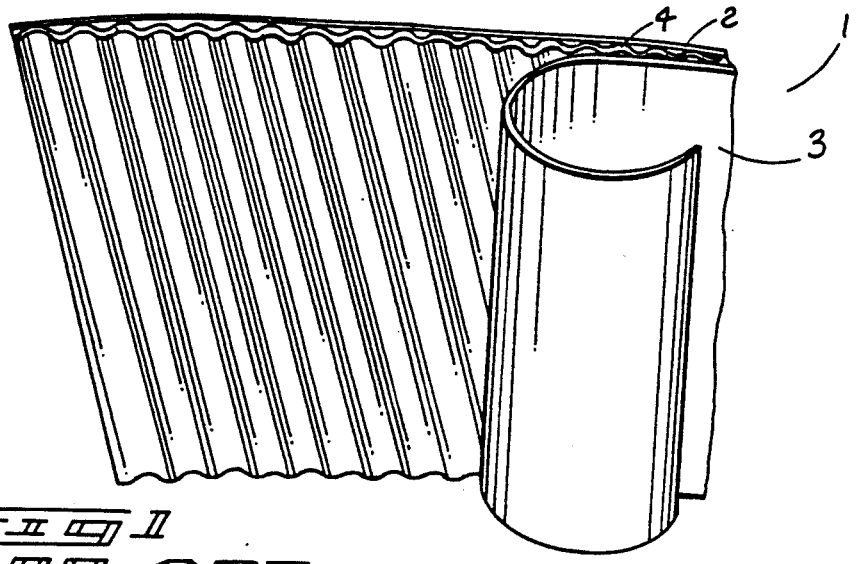
FIG 1
PRIOR ART
FIG 2
PRIOR ART
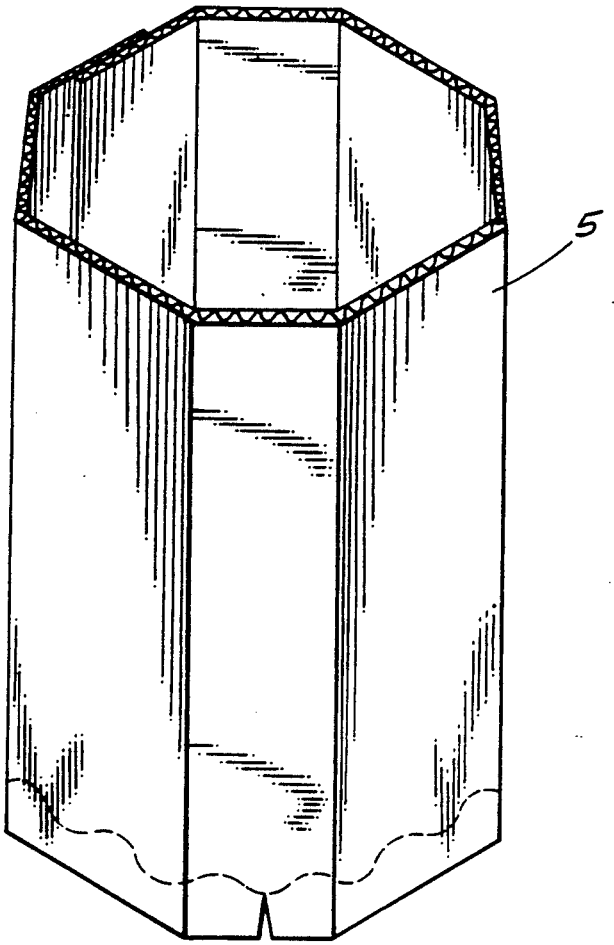

INSULATED BEVERAGE CONTAINER

BACKGROUND OF THE INVENTION

1. Field of the Invention

The field of the invention relates to beverage containers, and more particularly pertains to a new and improved insulated beverage container wherein the same utilizes novel corrugating mediums to provide integrity and insulation to the body of the container.

2. Description of the Prior Art

Beverage containers utilizing a single wall in the containment of various fluids have been provided with various draw backs. Various polymeric type drinking cups are not biodegradable and accordingly provide an ecological problem in their disposal subsequent to their use. Fibrous type beverage containers of a single wall do not provide adequate insulative properties in association with liquids contained therewithin. To provide a container of adequate insulative properties as well as structural integrity, a corrugated insulative container is utilized. Examples available in the prior art may be found in U.S. Pat. No. 4,398,650 to HOLMES et al wherein a single of plurality of corrugation mediums are formed within a beverage container wall wherein each corrugating medium is mounted between respective side walls of the body of the said formed container.

U.S. Pat. No. 2,757,790 to GATTUSO provides an insulative type receptacle utilizing spaced walls to provide insulation to a fluid contained therewithin.

U.S. Pat. No. 4,586,627 to GRIGSBY provides a bulk material container utilizing a series of spaced walls each utilizing various corrugations mounted therebetween in an apparent random association of corrugations.

U.S. Pat. No. 4,632,273 to RHIME sets forth an insulated container utilizing plural walls to effect insulation.

As such, it may be appreciated that there continues to be a need for a new and improved insulated beverage container as set forth by the instant invention wherein the same addresses both the problems of ease of use as well as effectiveness in construction in providing an insulated wall structure maintaining structural integrity of the organization and in this respect, the present invention substantially fulfills this need.

SUMMARY OF THE INVENTION

In view of the foregoing disadvantages inherent in the known types of insulated beverage containers present in the prior art, the present invention provides a new and improved insulated beverage container wherein the same utilizes spaced walls and an insulative corrugating medium therebetween to effect insulation and integrity between the plurality of walls. As such, the general purpose of the present invention, which will be described subsequently in greater detail, is to provide a new and improved insulated beverage container which has all the advantages of the prior art insulated beverage containers and none of the disadvantages.

To attain this, the insulated beverage container of the invention includes a container organization including an exterior wall spaced from an interior wall defining a conical body formed with a reinforced rib at its upper end and a floor at its lower end. The body includes an insulated medium therebetween. The insulated medium includes circumferentially equally spaced ribs therealong either alone or in association with a sinusoidal corrugating medium wherein the corrugating medium may be mounted directly to the ribs or spaced therefrom by an intermediate wall. A plurality of insulated mediums may be utilized offset relative to one another by one-half amplitude relative to one another to effect adhesive contact between upper and lower peaks of respective lower and upper sinusoidal corrugating mediums. Further a single sinusoidal medium may be utilized spaced from the interior and exterior walls by offset ribs adhesively mounted to alternating upper and lower peaks of the corrugating medium.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved insulated beverage container which has all the advantages of the prior art insulated beverage containers and none of the disadvantages.

It is another object of the present invention to provide a new and improved insulated beverage container which may be easily and efficiently manufactured and marketed.

It is a further object of the present invention to provide a new and improved insulated beverage container which is of a durable and reliable construction.

An even further object of the present invention is to provide a new and improved insulated beverage container which is susceptible of a low cost of manufacture with regard to both materials and labor, and which accordingly is then susceptible of low prices of sale to the consuming public, thereby making such insulated beverage containers economically available to the buying public.

Still yet another object of the present invention is to provide a new and improved insulated beverage container which provides in the apparatuses and methods of the prior art some of the advantages thereof, while simultaneously overcoming some of the disadvantages normally associated therewith.

Still another object of the present invention is to provide a new and improved insulated beverage container which may be compactly stored when not being utilized.

Yet another object of the present invention is to provide a new and improved insulated beverage container wherein the same effects insulation of fluids contained therewithin as well as maintaining structural integrity of the container body.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art wall structure utilized in a formation of beverage containers.

FIG. 2 is an isometric illustration of a prior art beverage container.

DESCRIPTION OF THE PREFERRED EMBODIMENT

Figure 3:
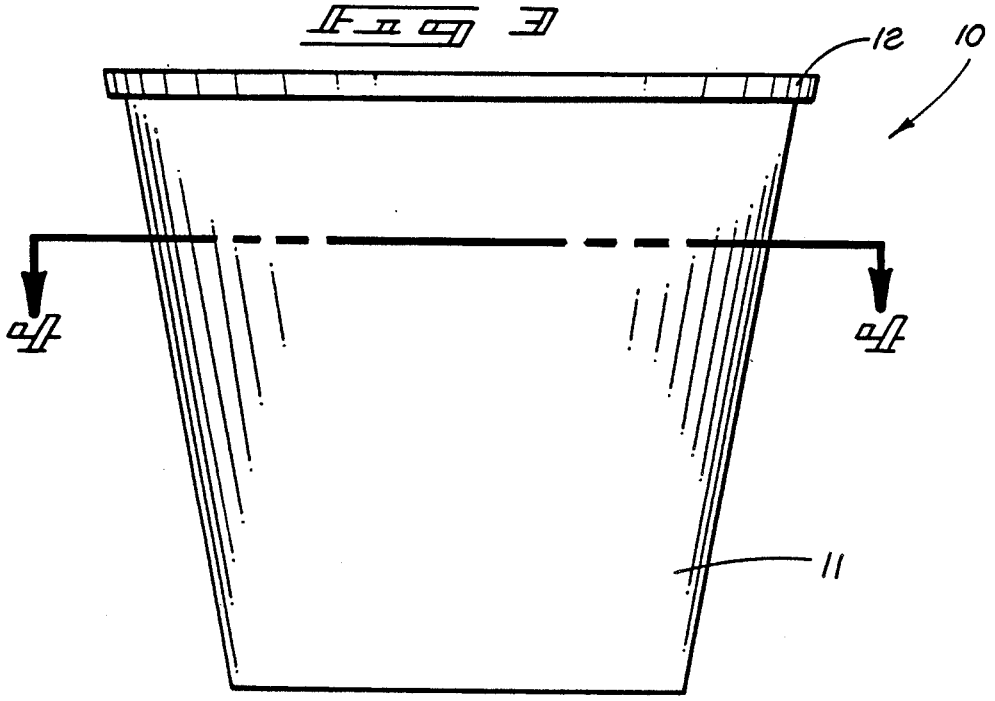
FIG. 3 is an orthographic view taken in elevation of the instant invention.

With reference now to the drawings, and in particular to FIGS. 1 to 12 thereof, a new and improved insulated beverage container embodying the principles and concepts of the present invention and generally designated by the reference numeral 10 will be described.

FIG. 1 illustrates a prior art body wall structure 1 wherein an exterior wall 2 spaced from an interior wall 3 utilizes an angulated array of a fluted corrugating medium 4 mounted therebetween to provide a wall structure in a manner as illustrated in the body 5 as set forth in FIG. 2.

Figure 4:
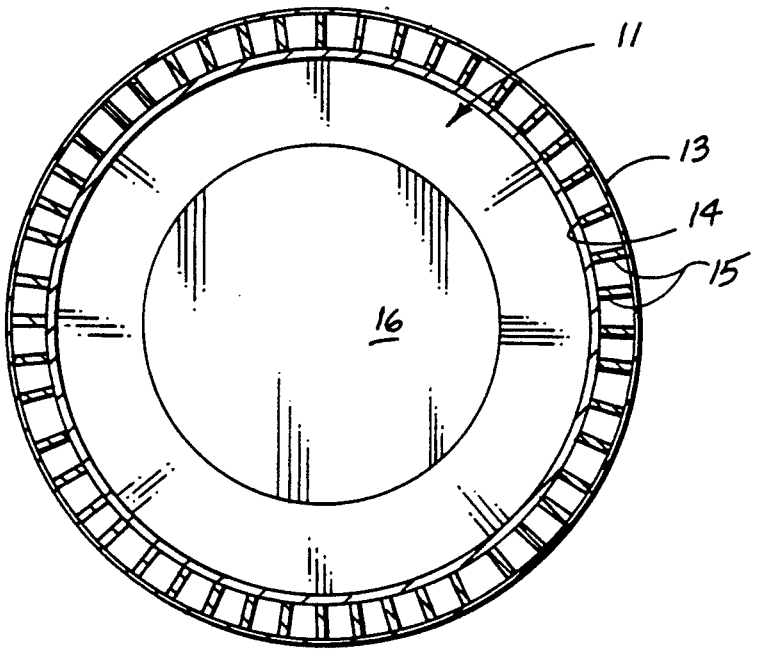
FIG. 4 is an orthographic view taken along the lines 4—4 of FIG. 3 in the direction indicated by the arrows.
Figure 5:
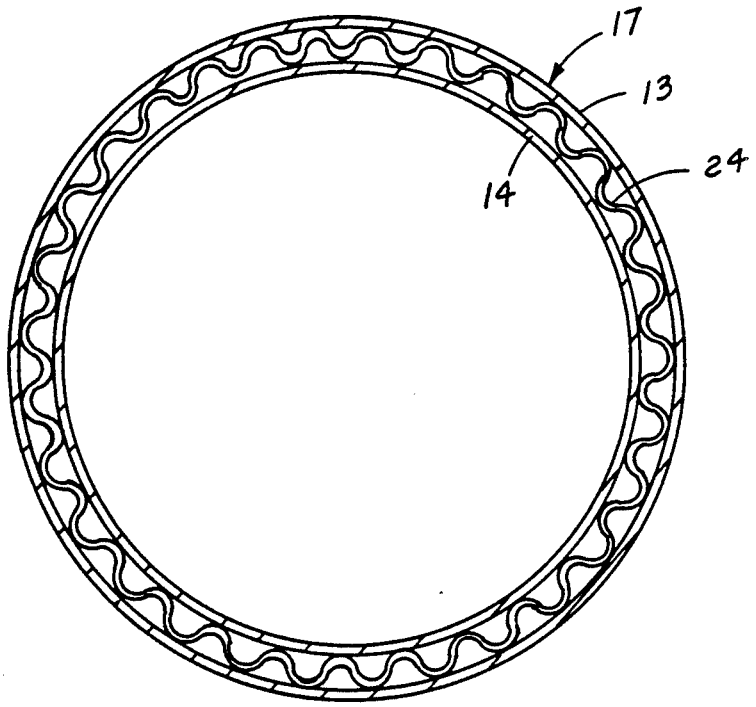
FIG. 5 is a first modified body wall structure utilized by the instant invention.

More specifically, the insulated beverage container 10 of the instant invention essentially comprises an inverted truncated conical body 11 including a reinforced upper circumferential rim 12 overlying a floor 16 wherein the floor 16 is orthogonally aligned relative to the axis of the body 11. The body 11 includes an exterior conical wall 13 spaced from an interior conical wall 14 a predetermined spacing. Reference to FIG. 4 illustrates the use of planar ribs 15 spaced circumferentially between the interior and exterior walls circumferentially an equal distance relative to one another and wherein each rib is radially aligned with the axis of the conical body 11. It is contemplated that the ribs be adhesively secured between the interior and exterior walls 14 and 13.

Figure 6:
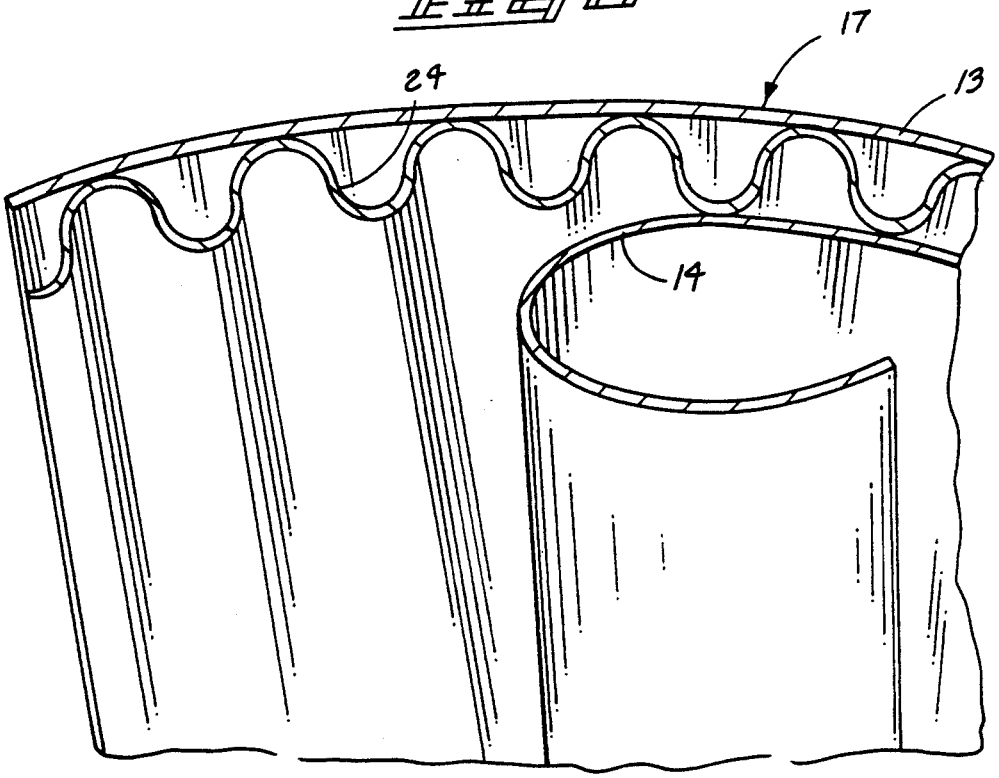
FIG. 6 is an isometric illustration of the body wall structure as illustrated in FIG. 5.
Figure 7:
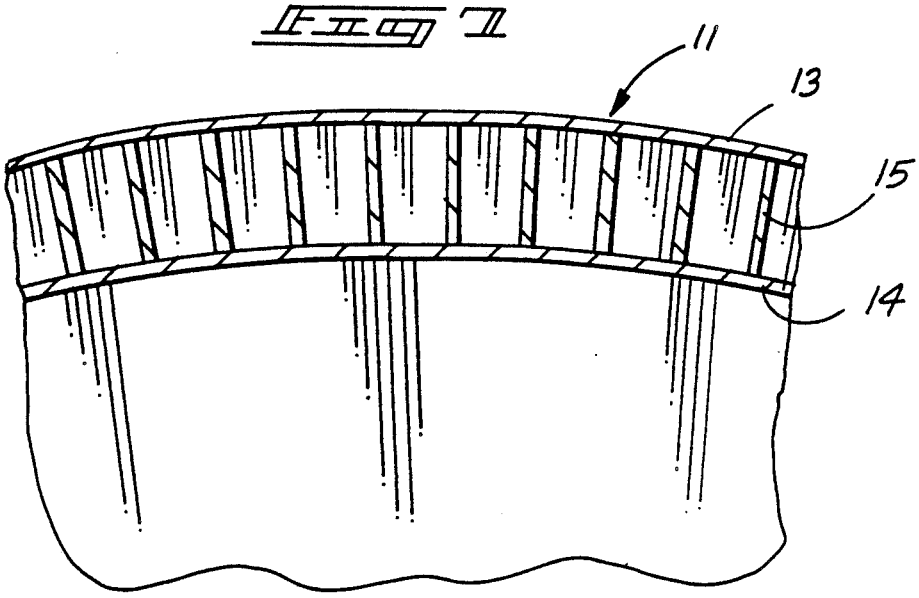
FIG. 7 is an isometric illustration of the body wall structure as set forth in FIG. 4.
Figure 8:
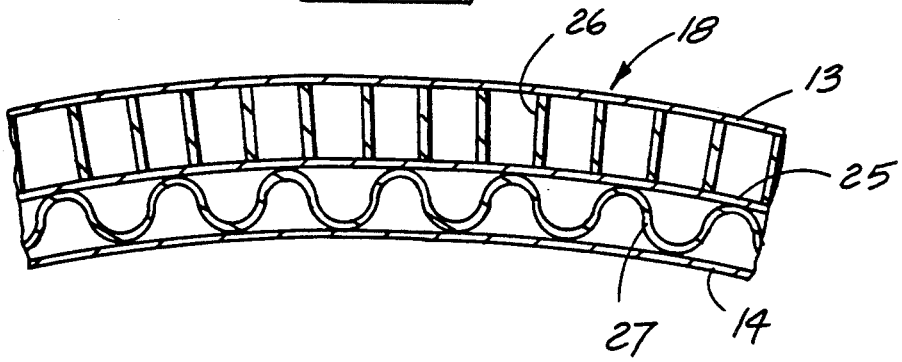
FIG. 8 is a second modified body wall structure utilized by the instant invention.

FIG. 8 illustrates the use of a single sinusoidal corrugating sheet 24 mounted coextensively through the spacing defined between the interior and exterior walls and adhesively mounted therebetween in a manner wherein the various layers are laminated relative to one another in a manner as illustrated in FIG. 6.

FIG. 8 illustrates the use of an intermediate wall 25 spaced medially between and coextensively with the interior and exterior walls with a modified series of ribs 26 defined by a height substantially equal to one half of a predetermined height defined by the ribs 15 wherein the interior and exterior walls are spaced in equal predetermined spacing. Therefore a modified sinusoidal corrugating medium 27 is laminated between the intermediate wall 25 and the interior wall 14. The modified ribs 26 are also circumferentially equal distance relative to one another and radially aligned in a manner as there in above. Further, the peaks of the sinusoidal corrugating medium 27 are positioned medially of every alternate spacing between pairs of the ribs 26 as illustrated in FIG. 8.

Figure 9:
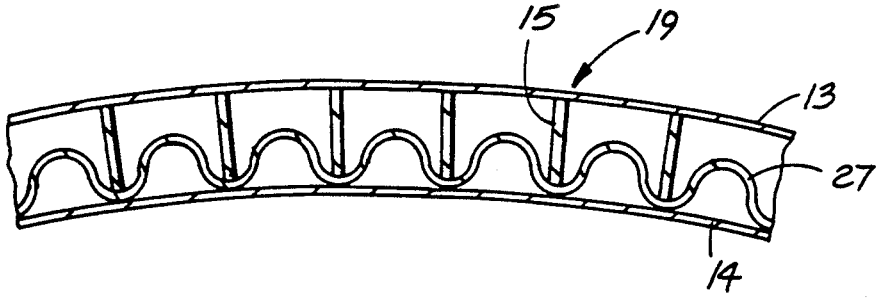
FIG. 9 is a third modified body wall structure utilized by the instant invention.

FIG. 9 illustrates the use of the planar ribs 15 further including the modified sinusoidal corrugating medium 27 defined by an amplitude substantially equal to one-half of the predetermined spacing between the interior and exterior walls. The use of the modified corrugating medium 27 with a single amplitude directed medially between spacing between each of adjacent ribs 15 divides the chambers defined by the ribs 15 to enhance insulative properties of the associated body structure.

Figure 10:
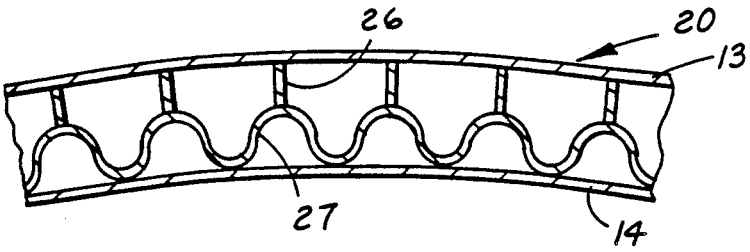
FIG. 10 is a fourth modified body wall structure utilized by the instant invention.

FIG. 10 illustrates the use of a fourth modified body wall structure 20 wherein the modified ribs 26 bisect each upper peak of the modified single sinusoidal corrugation to divide the spacing between interior and exterior walls 13 and 14 into relatively compressible chambers to provide cushioning of the beverage container as well as providing insulative chambers therebetween. As illustrated, the modified ribs 26 are adhesively mounted to an interior surface of the exterior wall 13 at a rearward end thereof and at a forward end of each of the ribs 26 are adhesively mounted to a peak of the sinusoidal corrugation medium 27.

Figure 11:
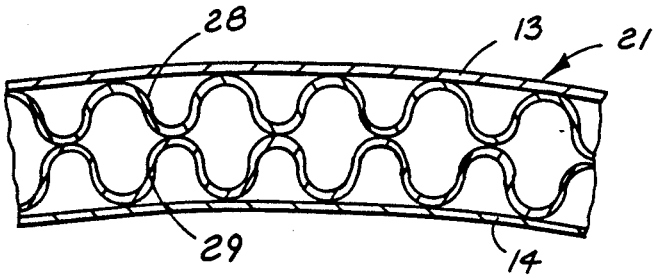
FIG. 11 is a fifth modified body wall structure utilized by the instant invention.

FIG. 11 illustrates the use of a first and second sinusoidal corrugating medium 28 and 29 each defined by an amplitude substantially equal to one-half of the predetermined spacing between the interior and exterior walls 13 and 14. The first and second sinusoidal corrugating mediums are adhesively mounted to one another wherein the second sinusoidal corrugating medium is shifted one-half phase relative to the first sinusoidal corrugating medium 28 such that the lower-most peak of the first corrugating medium is adhesively mounted to an upper-most peak of the second corrugating medium 29.

Figure 12:
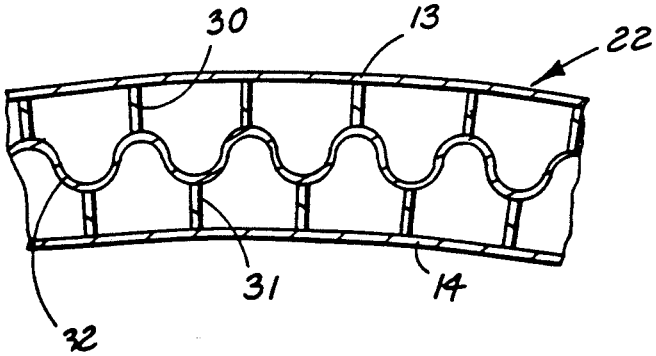
FIG. 12 is a sixth modified body wall structure utilized by the instant invention.

FIG. 12 illustrates a sixth modified body wall structure 22 wherein first ribs 30 are of a height substantially equal to one-third of the predetermined spacing between the interior and exterior walls 13 and 14 and are spaced apart an equal distance relative to one another circumferentially and each are radially aligned relative to the axis of the body 11. Second ribs 31 also of a like configuration to that of the first ribs 30 are offset to bisect spacing between the first ribs with an intermediate sinusoidal corrugating medium 32 defined by amplitude one-third that of the predetermined spacing between the interior and exterior walls 13 and 14 such that each peak of the intermediate sinusoidal corrugating medium 32 is adhesively secured to an interior end of a first rib 30 while each lower-most valley peak of the intermediate sinusoidal corrugating medium 32 is adhesively mounted to an inner-most end of the second ribs 31. The structure of FIG. 12 permits enhanced cushioning of the organization as well as insuring enhanced insulative properties due to the compartmental configurations defined by the first and second ribs 30 and 31 as well as the intermediate sinusoidal corrugating medium 32.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An insulated beverage container comprising, a tubular interior wall defined about an elongate axis, and a tubular exterior wall, the tubular exterior wall coaxially arranged relative to the elongate axis in a surrounding relationship relative to the interior wall and coextensively formed therewith, and a floor mounted to lowermost ends of the interior and exterior walls orthogonally arranged to the elongate axis defined by the interior and exterior walls, the interior wall spaced from the exterior wall by a predetermined spacing, and corrugating means adhesively mounted within the predetermined spacing for effecting insulation and cushioning of the exterior wall relative to the interior wall, and the corrugating means includes a series of equally spaced planar ribs, the planar ribs circumferentially spaced relative to one another within the predetermined spacing and wherein the ribs are radially aligned relative to the elongate axis of the interior and exterior walls, and wherein the ribs include first ribs, the first ribs defined by a first length equal to one-third of the predetermined spacing, the first ribs integrally mounted to the exterior wall within the predetermined spacing and spaced apart a first spacing, and second ribs defined by a second length equal to one-third of the predetermined spacing and integrally mounted to the interior wall within the predetermined spacing wherein the second ribs and the first ribs are radially aligned relative to the elongate axis, and the second ribs are offset relative to the first ribs to bisect the first spacing between the first ribs, and the corrugating means includes a sinusoidal corrugating medium medially mounted within the predetermined spacing between the interior wall and the exterior wall wherein the corrugating medium is defined by a sinusoidal amplitude equal to one-third of the predetermined spacing between the interior and exterior walls and includes sinusoidal peaks fixedly secured to the first ribs and sinusoidal valleys fixedly secured to the second ribs.

* * * * *